United States Patent [19]

Kulke et al.

[11] 4,136,654

[45] Jan. 30, 1979

[54] FUEL INJECTION NOZZLE FOR PRELIMINARY AND MAIN INJECTION INTO INTERNAL COMBUSTION ENGINES

[75] Inventors: Günter Kulke, Esslingen; Odon Kopse; Gregor Schuster, both of Stuttgart, all of Fed. Rep. of Germany

[73] Assignee: Robert Bosch GmbH, Stuttgart, Fed. Rep. of Germany

[21] Appl. No.: 751,290

[22] Filed: Dec. 16, 1976

[30] Foreign Application Priority Data

Dec. 24, 1975 [DE] Fed. Rep. of Germany ..... 2558766

[51] Int. Cl.[2] ..... F02M 39/00

[52] U.S. Cl. ..... 123/139 AT; 123/139 AK

[58] Field of Search .... 123/139 R, 139 AT, 139 AK, 123/139 AC; 251/60, 284, 285; 239/533.8, 533.6, 533.5, 533.11, 533.12, 584, 585

[56] References Cited

U.S. PATENT DOCUMENTS

| | | | |
|---|---|---|---|
| 2,642,718 | 6/1953 | Pearl | 251/285 |
| 3,516,395 | 6/1970 | Bassot et al. | 123/130 AC |
| 3,830,433 | 8/1974 | Miyake et al. | 239/585 |

FOREIGN PATENT DOCUMENTS

| | | | |
|---|---|---|---|
| 1007807 | 2/1952 | France | 123/139 AT |

*Primary Examiner*—Charles T. Jordan

*Attorney, Agent, or Firm*—Edwin E. Greigg

[57] ABSTRACT

This invention discloses fuel injection nozzles for internal combustion engines which are known to have a needle valve that is shiftable under pressure of the fuel supply against the force of a closing spring and more particularly the improvement wherein the opening stroke of the needle valve can be changed by a transversely movable slide element that includes a spool-like body having a medial area of varying diameter which serves to limit the stroke of the needle valve.

12 Claims, 3 Drawing Figures

13
28
24
25
26
27
18
17
30
19
12
16
29
10
14
15
20
9
21
8
7
11
6
5
1
2
3
4
32
35
34

FUEL INJECTION NOZZLE FOR PRELIMINARY AND MAIN INJECTION INTO INTERNAL COMBUSTION ENGINES

BACKGROUND OF THE INVENTION

The invention relates to a fuel injection nozzle and more particularly to an injection valve for both preliminary fuel injection as well as main fuel injection and involves a construction in which a needle valve is shiftable under pressure of the supplied fuel against the force of the closing spring with the opening stroke of the needle valve being controlled by a slide element which serves as a limiting means for the stroke of the needle valve. With such a fuel injection nozzle, the valve opening cross section in the case of engine idling and for low partial loads should be smaller than in the case of higher loads. In addition, a smaller opening cross section creates improved atomization of the fuel volume determined by the load resulting in better fuel preparation. As a consequence, the engine runs more quietly and combustion is improved.

At higher loads and rpm, however, the largest possible opening cross section should be available from the very beginning in order to maintain the volume of fuel flow required by modern, fast running Diesel engines while maintaining reasonable physical dimensions.

OBJECTS AND SUMMARY OF THE INVENTION

Accordingly, it is an object of this invention to provide a fuel injection nozzle of the initially described type in which control is exerted on the needle valve with a simple means which in the case of idling and low partial load, provides a lesser opening stroke of the needle valve than is provided for when the engine is under higher loads.

A further object of the invention is to provide a reciprocable slide element in a chamber that extends perpendicular to the axis of the needle valve, said needle valve being shiftable by liquid flow from a hydraulic means counter to the force of a return spring, said slide element including a body portion having a varying diameter with which the needle valve is arranged to cooperate. Thus, depending on which position the slide element assumes under control of the hydraulic means, the possible opening stroke of the needle valve is variable. In the case of an idling rpm and a low partial load, the stroke of the needle valve is thus kept smaller than in the case of a higher load.

Fuel injection nozzles are well known, particularly those which are adapted to control both preliminary fuel injection as well as main fuel injection. In such constructions, the slide element has been disposed coaxially relative to the needle valve, and the fuel which is injected to the injection nozzle by the injection pump serves as the control liquid for the slide element. In this nozzle, known in the prior art, preliminary fuel injection as well as main fuel injection is accomplished by making the surface near the slide element, which is acted upon by the fuel supply, smaller than the surface which is effective in the valve opening direction. Also, throttle means are disposed in the bore leading to the pressure chamber of the fuel injection valve as well as that which leads to the slide element, the cross sections of the throttles being matched to one another in appropriate manner. Apart from the fact that such matching is exceedingly difficult, the throttle disposed in the channel leading to the pressure chamber has a disadvantageous throttling effect in the case of greater quantities of fuel, i.e., for full load operation. This last disadvantage is effective especially in the case of fast running Diesel engines as used in passenger cars, thus just in those types of vehicles where the greatest value is put on quiet operation.

The invention will be better understood as well as other objects and advantages thereof will become more apparent from the following detailed description of the invention taken in conjunction with the drawing.

DESCRIPTION OF THE PREFERRED EMBODIMENTS

Figures 1, 2, 3:
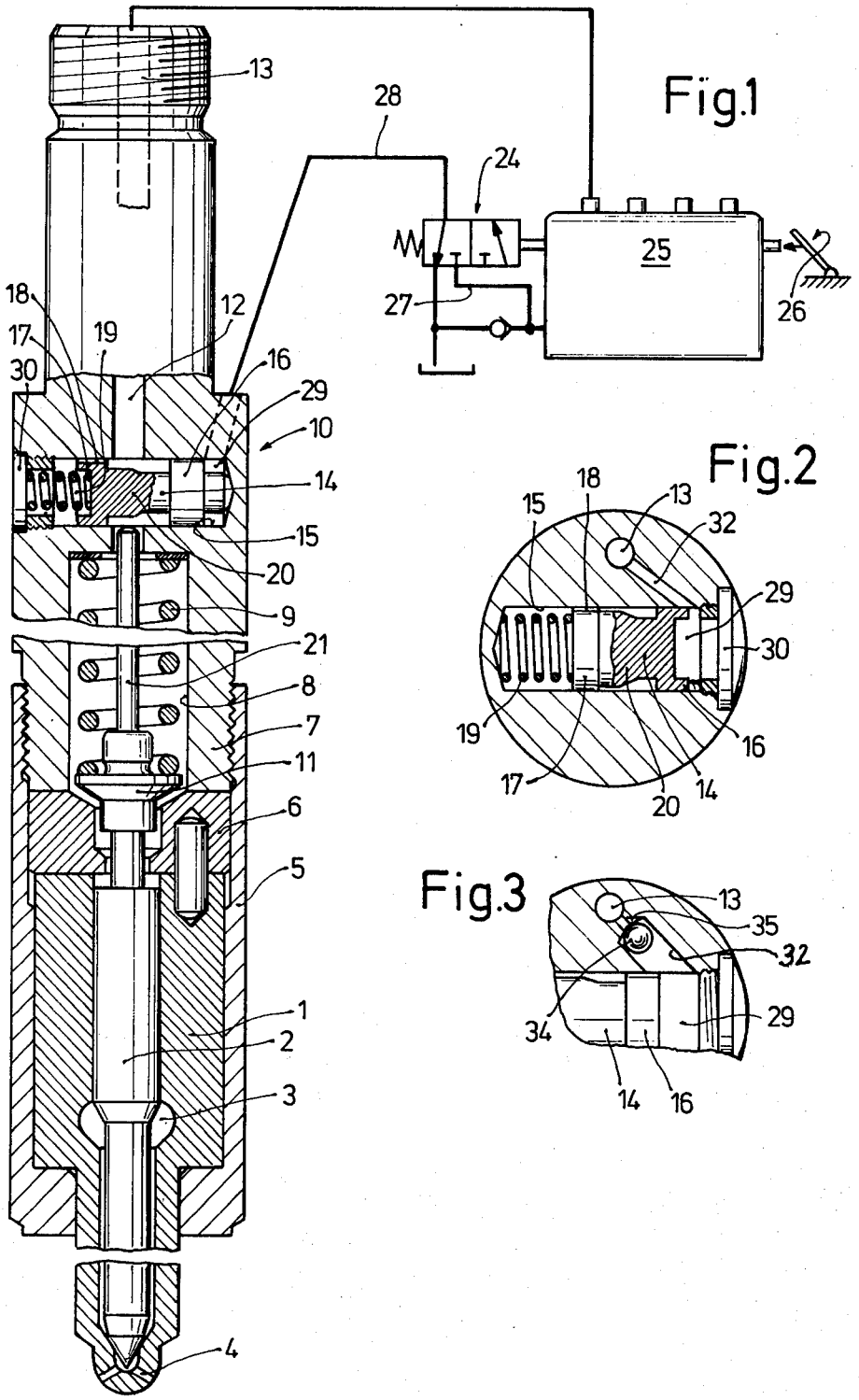
FIG. 1 shows the first embodiment with a balanced slide element.
FIG. 2 shows a second embodiment with an automatically controlled slide element.
FIG. 3 is a schematic showing of the structure of FIG. 2 which further includes a check valve.

Turning now to the drawing of FIG. 1, there is shown a nozzle body 1, within which is axially and shiftably disposed a needle valve 2, all of which is known from the prior art. A pressure chamber 3 is defined by the body of the nozzle 1 and the needle valve 2 which is lifted from its seat, permitting the fuel fed thereto by an injection pump to reach the combustion chamber of the engine via the injection orifices 4.

The nozzle body 1 is secured to a nozzle holder 7 by means of a clamping nut 5 with a disc 6 being disposed therebetween, said nozzle holder including an upper spring chamber 8 for a closing spring 9. The closing spring 9 is associated, on the one hand, by way of a mechanism indicated generally at 10, which mechanism is carried by the nozzle holder 7, and on the other hand, acts by means of a spring plate 11 to urge the needle valve 2 downwardly. The spring chamber 8 is relieved of pressure by a longitudinal bore 12 which extends through the nozzle holder 7. The fuel, which is fed by the injection pump, is supplied through the nozzle holder and the body of the nozzle to the pressure chamber 3 by way of a pressure line 13 indicated generally by dotted lines. A slide 14 serves as a stop for the needle valve 2 with said slide being disposed shiftably in a bore 15 which is disposed at right angles relative to the axis of the injection nozzle. The slide 14 includes a spool-like body having end areas 16 and 17 and a medial portion 20 of varying diameter. The one end wall 16 is slidably scaled relative to the bore 15 and the other end wall is provided with a by-pass groove 18 that extends longitudinally thereof to allow for fuel leakage behind said wall for a purpose that will be later better understood as the description progresses. A spring 19 is disposed between the one end wall 17 of the spool-like body and a threaded cap 30 which is arranged to be received in the threaded opening of bore 15. The medial area 20 of the spool-like slide has been provided between the end walls 16 and 17 with a contour which is symmetrical but includes land areas of different extent that are adapted to cooperate with a rod 21 which serves as an extension of the needle valve 2. Depending on the position of the slide 14, i.e. depending on the section of the contour 20 opposite the rod 21, a larger or smaller opening stroke of the needle valve 2 is possible. In the rest position of the slide 14 as shown, the movement of rod 21 is limited and its maximum stroke is small; in the extended position of the slide, corresponding to higher loads, the movement is corresondingly greater.

In the case of the first embodiment shown in FIG. 1, the slide 14 is controlled by means of a hydraulic valve 24, which, in turn, is controlled by a fuel injection pump 25 which, as is well known, is controlled in dependence on the load, namely, by the accelerator pedal 26. Fuel is fed from the intake of the pump by way of the conduit 27 as an adjusting liquid under the control pressure and after leaving the hydraulic valve 24 passes through the line 28 to the space 29 which is located on the front side of the end wall 16 of the slide 14. The hydraulic valve 24 is adjusted above the idling speed or the low partial load by means of the accelerator pedal 26 of the fuel injection pump 25 and thereby connects the line 27 with the line 28, so that the pressure acting on the front face of the slide 14 is the pressure prevailing in the suction chamber of the fuel injection pump 25, shifting the latter into its other terminal position in opposition to the force of the spring 19.

The second embodiment of the invention is shown in FIGS. 2 and 3 and operates on the same principle as the first embodiment by limiting the stroke of the needle valve. In FIG. 2 the view of the nozzle holder 7 is taken on a line which is perpendicular to the level of the slide 14 as seen from above. As a result the pressure channel 13 which leads from the upper front side of the fuel injection nozzle to the pressure chamber 3 becomes visible. A throttling channel 32 branches off from the pressure channel 13 to the bore 15, which is developed preferably as a dead end bore in the case of the first embodiment and as shown, branches off to the space 29 beside the end wall 16 of the slide 14. In the first embodiment the bore 15 is closed by the threaded cap 30 being positioned on the side against which the spring has been arranged, and in the second embodiment, this space 29 is closed by the threaded cap 30.

In the case of low rpms and a low partial load, the time intervals between the individual injection strokes are relatively long. The effective flow cross section of the bore 32 is chosen so that the slide 14 makes a certain stroke during the fuel injection process, but in any case, it again reaches its initial position during the pauses in the injection process. This will assure that, in the case of a low partial load and idling, the rod 21 of the needle valve 2 always strikes that portion of the contour 20 which permits only a small stroke.

In the case of higher rpm, however, the duration of the pressure stroke is at least as long and with increasing rpm correspondingly longer than before so that the time interval between the injection processes is smaller. Thus, for a medium partial load and higher load, the bore 32 will no longer permit a return of the slide 14 into the rest position, but will push the slide 14 against the force of the spring 19 into its extreme position, from which it always begins a slight return stroke in the pauses between injections. This return stroke is always so small that the section of the contour 20 cooperating with the rod 21 of the needle valve 2 permits a relatively larger stroke. As soon as the rpm of the engine or the load drops back again, the effective flow cross section during the pauses in injection also increases so that the slide 14 again returns to its starting position.

FIG. 3 shows a further variation of the second embodiment of this invention in which a check valve 34 is disposed in the bore 32 opening into the space 29. As a result, with this construction it is possible to achieve a variable throttling effect depending on the direction of fuel flow in the channel 32. The check valve 34 does not entirely close the bore 32 with respect to the pressure channel 13, but allows a throttled flow in this direction as a result of oblique grooves 35. However, the throttling effect in this direction is greater than in the opposite direction. A variable throttling effect, as hereby provided, makes for a better adaptation of the injection process to the prevailing engine conditions.

What is claimed is:

1. A fuel injection nozzle for internal combustion engines provided with a needle valve which is shiftable under pressure of the fuel supply against the force of a closing spring, the opening stroke of said needle valve being changeable by a movable slide which serves to limit the stroke of the needle valve, the improvement comprising said slide being disposed substantially transversely in relation to the symmetry axis of the needle valve and including a body portion having spaced end walls and a medial portion having a circular cross-sectional shape of varying diameter arranged to cooperate with the needle valve to limit the axial movement thereof and means responsive to the fuel pressure in the internal combustion engine for adjusting the position of said slide.

2. A fuel injection nozzle as defined in claim 1 wherein one of said end walls is urged in one direction by a spring means positioned in a chamber and another of said end walls being under the influence of the fuel supply.

3. A fuel injection nozzle as defined in claim 1 in which the said body portion comprises a spool-like member that is reciprocally disposed in a bore in said fuel injection nozzle.

4. A fuel injection nozzle as defined in claim 1 in which the fuel supply is utilized for said slide position adjusting means and is controlled by a solenoid valve.

5. A fuel injection nozzle as defined in claim 2 in which a portion of the fuel supply is introduced to the chamber containing said spring means by means of a by-pass in said body portion.

6. A fuel injection nozzle as defined in claim 3 in which said spool-like member is controlled by a hydraulic valve means.

7. A fuel injection nozzle as defined in claim 1 in which a hydraulic valve means actuates said body portion and suction pressure and a fuel injection pump feeds fuel to the injection nozzle.

8. A fuel injection nozzle as defined in claim 6 in which the hydraulic valve means is associated with a fuel injection pump.

9. A fuel injection nozzle as defined in claim 1 in which a portion of the fuel supply for said injection nozzle is fed to said body portion having spaced end walls and a medial portion of varying diameter.

10. A fuel injection nozzle as defined in claim 9 in which said fuel supplied to said body portion passes through a throttling means.

11. A fuel injection nozzle as defined in claim 10 in which said throttling means includes a check valve.

12. A fuel injection nozzle as defined in claim 11 in which said check valve is by-passed by a throttle which permits more limited flow away from said slide than toward said slide.

* * * * *